US008872048B2

(12) United States Patent
Neese et al.

(10) Patent No.: US 8,872,048 B2
(45) Date of Patent: Oct. 28, 2014

(54) ILLUMINATED THUMBWHEEL SWITCH ASSEMBLY

(75) Inventors: Thomas A. Neese, Columbus, IN (US); Charles V. Edwards, Nashville, IN (US); David E. Zink, Greenwood, IN (US)

(73) Assignee: Nidec Motor Corporation, St. Louis, MO (US)

( * ) Notice: Subject to any disclaimer, the term of this patent is extended or adjusted under 35 U.S.C. 154(b) by 261 days.

(21) Appl. No.: 13/302,538

(22) Filed: Nov. 22, 2011

(65) Prior Publication Data

US 2013/0126318 A1 May 23, 2013

(51) Int. Cl.

*H01H 9/00* (2006.01)
*H01H 19/02* (2006.01)
*H01H 19/635* (2006.01)

(52) U.S. Cl.

CPC ..... *H01H 19/025* (2013.01); *H01H 19/635* (2013.01)
USPC ..... 200/316

(58) Field of Classification Search

USPC ..... 200/11 R, 308–317, 179, 11 G, 11 TW, 200/6 BB, 19.07, 19.18, 336
See application file for complete search history.

(56) References Cited

U.S. PATENT DOCUMENTS

| | | | | |
|---|---|---|---|---|
| 4,679,588 | A | 7/1987 | Raab et al. | |
| 6,670,567 | B1 * | 12/2003 | Koseki et al. | 200/564 |
| 6,876,313 | B2 * | 4/2005 | Hsiung et al. | 341/35 |
| 7,166,810 | B2 * | 1/2007 | Hanahara et al. | 200/11 R |
| 7,202,428 | B2 * | 4/2007 | Ogawa et al. | 200/308 |
| 2011/0032058 | A1 | 2/2011 | Hoess et al. | |

FOREIGN PATENT DOCUMENTS

| | | | |
|---|---|---|---|
| DE | 19840070 | A1 | 3/2000 |
| DE | 102008006014 | A1 | 7/2009 |
| GB | 2376284 | A | 12/2002 |

OTHER PUBLICATIONS

International Search Report and Written Opinion from PCT Application No. PCT/US2012/053454 entitled Backlit Thumbwheel Switch Assembly (Dated Feb. 20, 2013).

* cited by examiner

*Primary Examiner* — Renee S Luebke
*Assistant Examiner* — Anthony R. Jimenez
(74) *Attorney, Agent, or Firm* — Hovey Williams LLP

(57) ABSTRACT

An electric switch assembly comprises a circuit board; a light source mounted on the circuit board; a thumbwheel knob rotatably mounted on the circuit board; a transparent surface that moves with the thumbwheel knob and on which a symbol is applied or formed; and a light guide for directing light from the light source to the transparent surface to illuminate the symbol.

9 Claims, 5 Drawing Sheets

ILLUMINATED THUMBWHEEL SWITCH ASSEMBLY

BACKGROUND

Electric switches often must be operated in low light environments and are therefore frequently back-lit or otherwise illuminated. Many switches also have illuminated graphics, words, or other symbols to identify their functions. For example, switches used to control the lights in an automobile are often illuminated and/or have illuminated symbols to identify their functions.

Symbols on pushbutton switches and similar switches are relatively easy to illuminate because the faces on which the symbols are applied don't move much relative to their back lights when they are operated. However, symbols on thumbwheel switches and other types of switches that rotate are more difficult to illuminate because the surfaces on which the symbols are applied move significantly relative to their back lights when the switches are operated.

SUMMARY

The present invention solves the above-described problems and provides a distinct advance in the art of illuminated switch assemblies. More particularly, the present invention provides an illuminated thumbwheel switch assembly or other rotary switch that more effectively illuminates a graphic, word, or other symbol on the switch over the entire range of motion of the switch.

An embodiment of the switch assembly comprises a circuit board; a light source mounted on the circuit board; a thumbwheel knob or similar knob rotatably mounted on the circuit board; a transparent surface on which a graphic, word, or other symbol is applied or formed; and a light guide for directing light from the light source to the transparent surface to illuminate the symbol. In one embodiment, the light guide is mounted inside the knob, the transparent surface is a transparent window formed on the light guide, and the knob includes an opening through which the transparent window extends.

The switch assembly may also comprise a pair of electrical contacts printed on or otherwise applied to the circuit board; an electrical conductor configured to contact and move relative to the contacts; and a rack and pinion assembly for moving the conductor relative to the contacts when the knob is rotated. An embodiment of the rack and pinion assembly comprises a rack coupled with the electrical conductor; and a pinion coupled with the light guide and operable to move the rack and the electrical conductor when the thumbwheel knob is rotated. The pinion may be integrally formed with the light guide, and the rack includes an opening for passing light from the light source to the light guide. The rack and pinion assembly advantageously translates rotational motion of the knob into linear motion of the conductor on the contact pads while simultaneously providing a constant distance from the light source to the symbol.

The switch assembly may further comprise a detent mechanism for providing tactile feedback when the thumbwheel knob is rotated. In some embodiments, the switch assembly may be integrated with other switch elements for selecting and controlling one or more lights or other electrical devices in an automobile.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
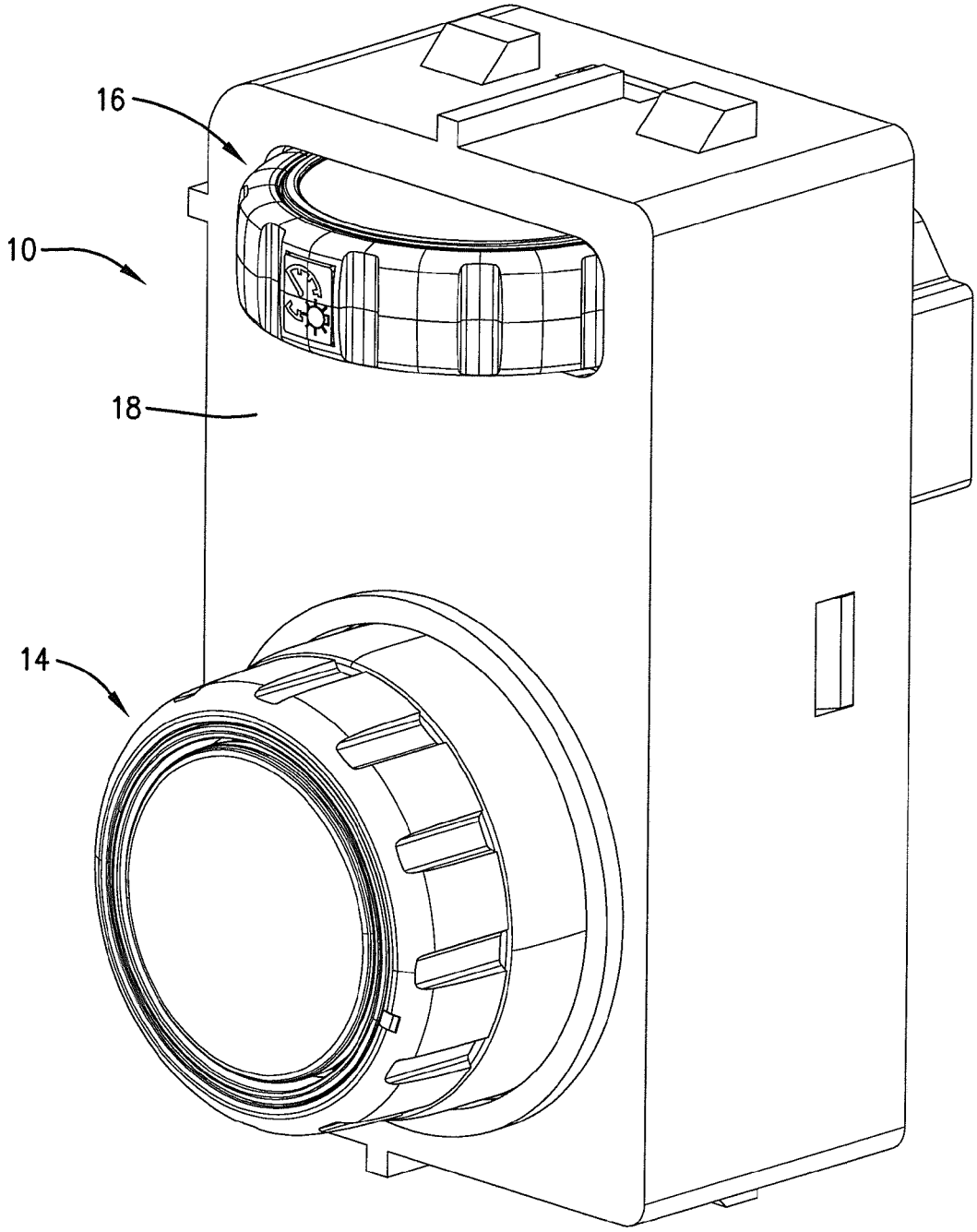
FIG. 1 is a perspective view of an exemplary switch assembly in which the thumbwheel switch assembly of the present invention may be integrated.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of embodiments of the invention references the accompanying drawings. The embodiments are intended to describe aspects of the invention in sufficient detail to enable those skilled in the art to practice the invention. Other embodiments can be utilized and changes can be made without departing from the scope of the claims. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 2:
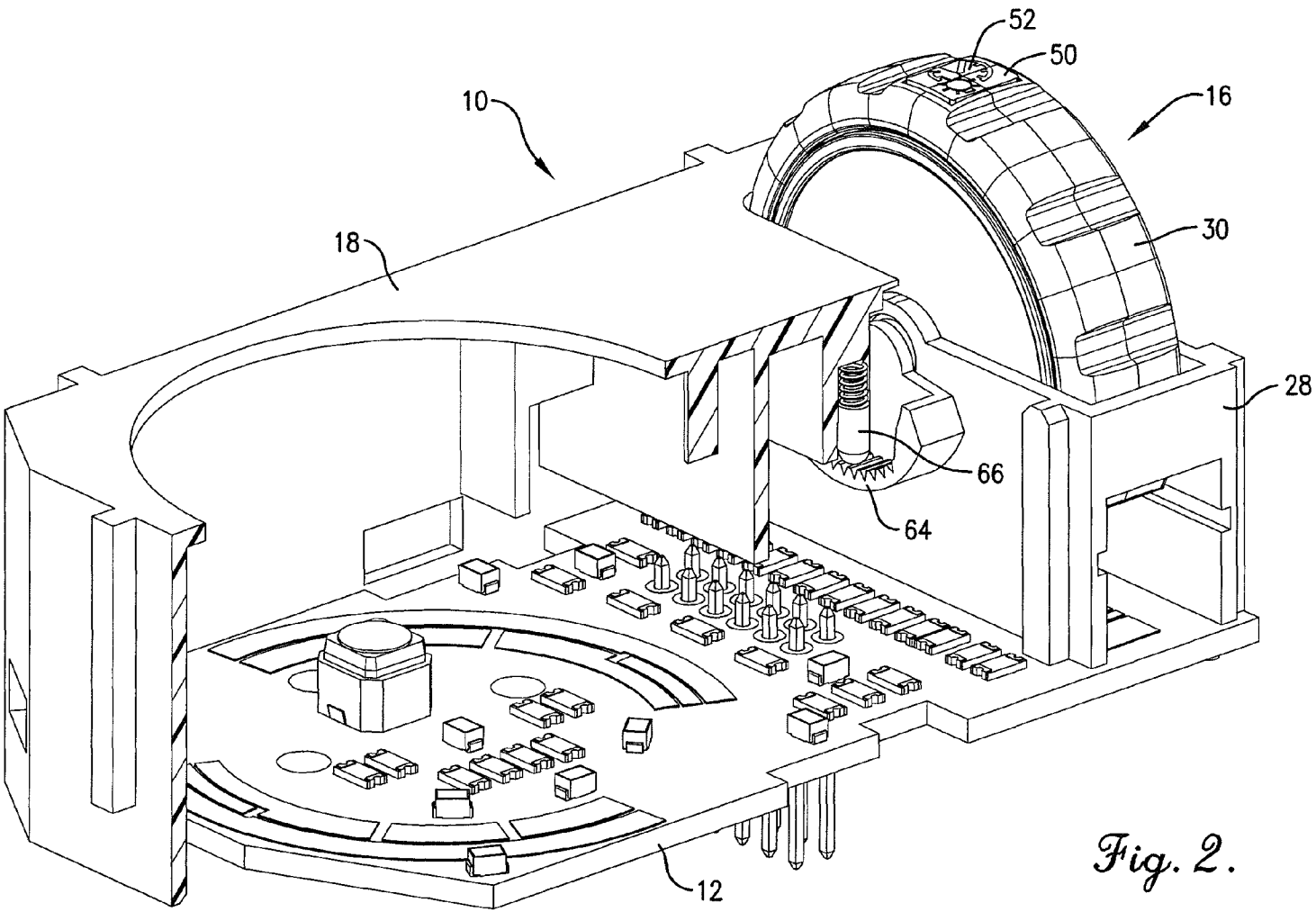
FIG. 2 is a perspective view in partial section of the switch assembly of FIG. 1.

Turning now to the drawing figures, and particularly FIGS. 1 and 2, a switch assembly 10 in which the thumbwheel switch of the present invention may be integrated is illustrated. An embodiment of the switch assembly 10 broadly comprises a circuit board 12; a rotary switch 14 or other type of switch coupled with the circuit board 12; the thumbwheel switch assembly 16 of the present invention; and a cover plate 18. The switch assembly 10 may be used to control any electrical device such as the lights in an automobile. For example, the rotary switch 14 may be used to turn on and/or select a vehicle's ceiling lights, dash lights, and/or reading lights and the thumbwheel switch assembly 16 may be used to dim one or more of these lights.

The circuit board 12 is mostly conventional and will not be described in detail herein. Among other components, the circuit board 12 includes a pair of spaced-apart contact pads 20, 22 or other electrical contacts best illustrated in FIGS. 3 and 4. The contact pads 20, 22 may consist of gold plating or any other conductive material printed on or otherwise attached to the circuit board 12. One of the contact pads 22 has a series of spaced apart contacts 24 that are connected to a plurality of resistors and/or other conventional electronic components on the circuit board 12. The contacts 20, 22, 24 and the resistors form a voltage divider or similar circuit for providing a variable signal to a light or other electrical device to dim or otherwise control the light or other electrical device as described in more detail below.

Figure 3:
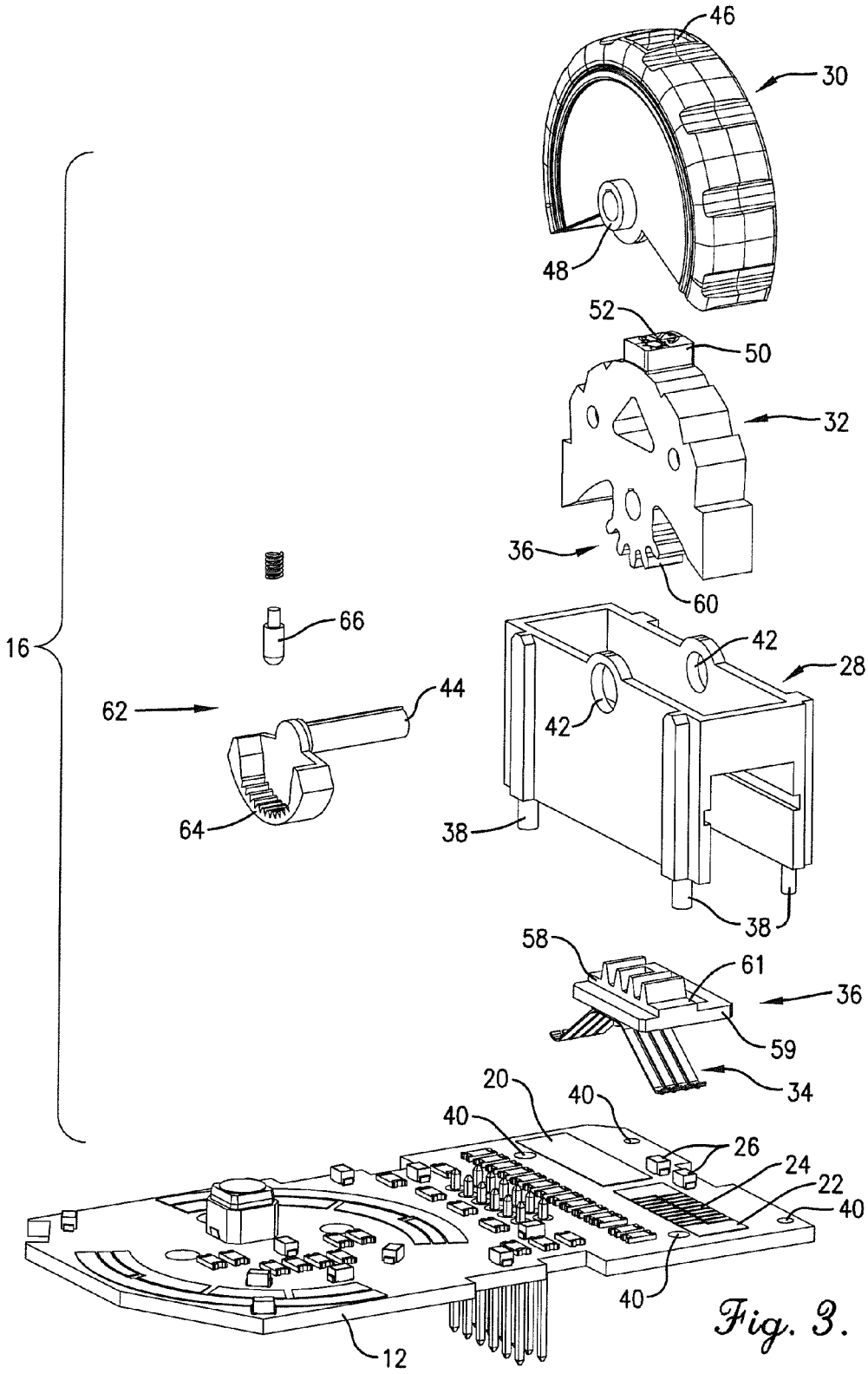
FIG. 3 is an exploded view of an embodiment of the thumbwheel switch assembly shown with a circuit board of the overall switch assembly.

As best shown in FIG. 3, a light source 26 is also mounted on the circuit board 12 to illuminate the thumbwheel switch 16 as described in more detail below. The light source 26 may include any number of LEDs or other lights.

The circuit board 12 may also include contacts and other electronic components for the rotary switch and other components not relevant to the present invention. The particular construction and configuration of the circuit board 12 as well as the components attached thereto is not critical to the invention and may be changed without affecting the scope of the invention.

As mentioned above, the rotary switch 14 may be used to select or otherwise control lights that may then be dimmed by the thumbwheel switch assembly 16. As with the circuit board 12, the particular construction and operation of the rotary switch 14 is not critical to the invention and may be changed without affecting the scope of the invention.

The thumbwheel switch assembly 16 may be integrated in the electrical switch 10 described above or another switch. Alternatively, the thumbwheel switch assembly 16 may be a stand-alone switch.

An embodiment of the thumbwheel switch assembly 16 is best illustrated in FIG. 3 and broadly comprises a carrier 28 mounted on the circuit board 12; a thumbwheel knob 30 rotatably mounted on the carrier 28; a light guide 32 for directing light from the light source 26 on the circuit board 12 to the thumbwheel knob 30; an electrical conductor 34 configured to contact and move relative to the contact pads 20, 22 on the circuit board; and a rack and pinion assembly 36 for moving the conductor 34 relative to the contacts 20, 22 when the thumbwheel knob 30 is rotated.

An embodiment of the carrier 28 may be in the general shape of an open ended hollow rectangular cube and includes a number of pegs 38 or legs for insertion into corresponding holes 40 in the circuit board 12. The sidewalls of the carrier include a pair of spaced-apart, aligned holes 42 for receiving a shaft 44 as described below.

The thumbwheel knob 30 serves as a user interface that may be rotated to dim a light or provide a variable electrical signal to any electrical device as described below. An embodiment of the knob 30 is generally semi-cylindrical in shape and includes a number of alternating ridges and depressions for improving its grip. The knob 30 also includes an opening 46 on its outermost surface for receiving a portion of the light guide 32 as described below. A keyed passageway 48 extends through the center of the knob 30 for receiving the shaft 44 to rotatably mount the knob on the carrier.

Figure 4:
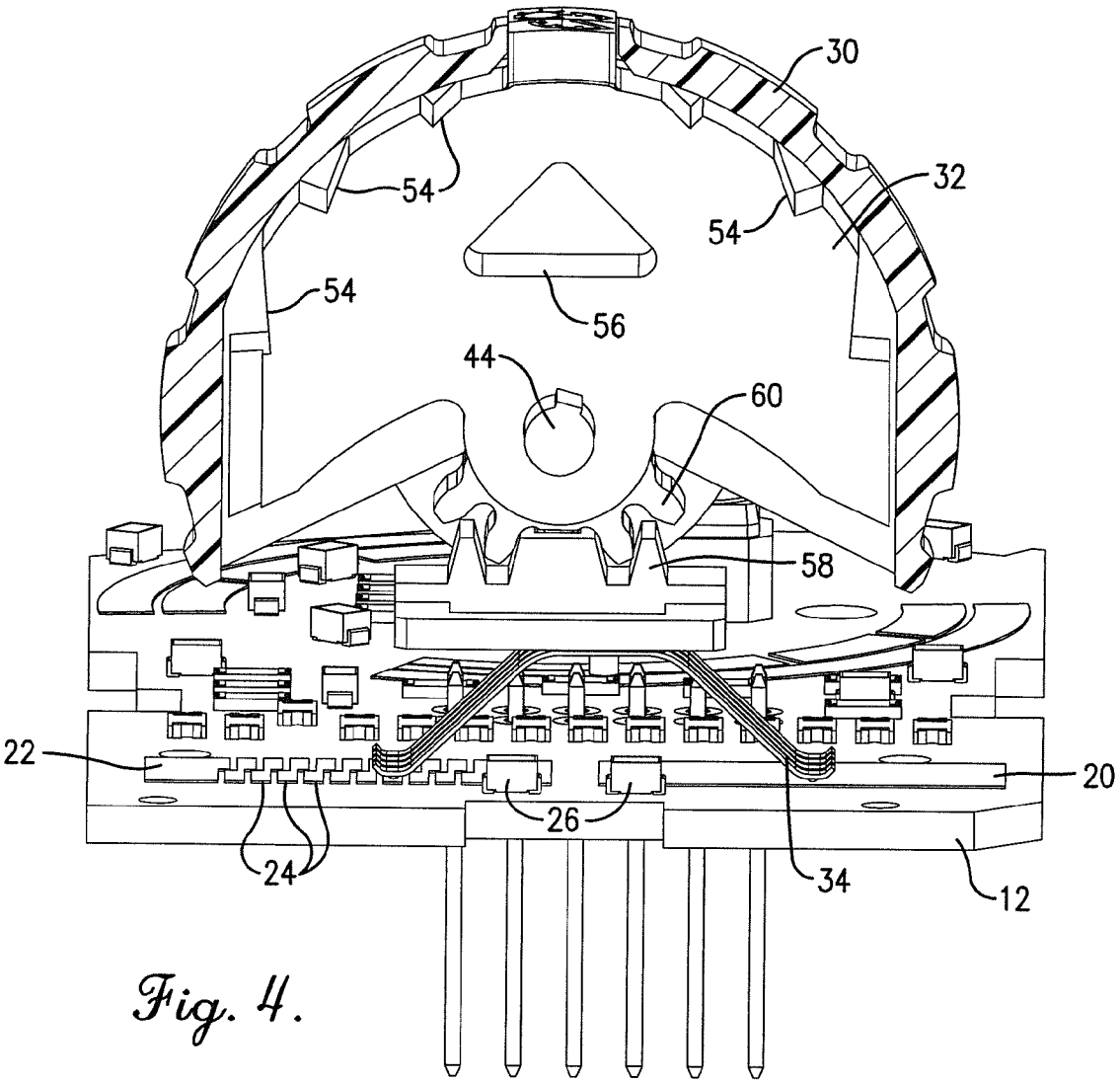
FIG. 4 is a perspective view in partial section of the thumbwheel switch assembly and circuit board.

The light guide 32 is provided for guiding or directing light from the light source 26 to the thumbwheel knob 30. In one embodiment, the light guide 32 fits within the thumbwheel knob 30 and includes an open bottom for receiving light from the light source and a transparent window 50 on which letters, numbers, words, graphics, or other symbols 52 are applied or formed. In one embodiment, a universal symbol for a light is painted and laser etched on the window 50. The transparent window 50 fits through the opening 46 in the thumbwheel knob 30 so that the surface on which the symbol is applied is relatively flush with the outermost surface of the knob. The light guide 32 also includes a number of angled walls 54 and a central aperture 56 for reflecting the light toward the transparent window 50 as best illustrated in FIG. 4.

The conductor 34 is provided for completing an electrical path between the contact pads 20, 22 and moves under the influence of the thumbwheel knob 30 to create a variable signal to the light or other electrical device controlled by the thumbwheel switch assembly. The conductor 34 may be any conductive device or component, and in one embodiment, includes a number of angled metal terminals that span the two contact pads 20, 22.

The rack and pinion 36 assembly is provided for converting rotational movement of the thumbwheel knob 30 into linear motion of the conductor 34 so as to move the conductor 34 on the contact pads 20, 22 as the thumbwheel knob is rotated. An embodiment of the rack and pinion assembly comprises a rack 58 coupled with the electrical conductor 34 and a pinion 60 coupled with the light guide 32.

An embodiment of the rack 58 includes a number of spaced apart teeth mounted on a relatively planar support 59. The rack 58 may also include an opening 61 on the planar support 59 for passing light from the light source to the light guide.

An embodiment of the pinion 60 includes a number of teeth arranged in an arc or curve that mesh with the teeth on the rack 58. The pinion 60 moves with the light guide 32 and moves the rack 58 and the electrical conductor 34 when the thumbwheel knob 30 is rotated. An embodiment of the pinion 60 is integrally formed with the light guide 32.

The rack and pinion design was selected because it effectively translates rotational motion of the thumbwheel knob 30 into linear motion of the conductor 34 on the contact pads 20, 22 while simultaneously providing a constant distance from the light source 26 to the symbol 52 throughout the entire range of motion of the thumbwheel knob. This allows the light source 26 and light guide 32 to effectively and consistently illuminate the symbol on all positions of the thumbwheel knob.

The switch assembly 10 may further comprise a detent mechanism 62 for providing tactile feedback when the thumbwheel knob 30 is rotated. An embodiment of the detent mechanism 62 includes a curved track 64 with gears or teeth and a spring-biased detent pin 66 positioned in a slot of the cover plate 18. The curved track 64 is attached to one end of the keyed shaft 44 so that it rotates with the shaft when the thumbwheel knob 30 is rotated. As the thumbwheel knob 30 and detent track 64 are rotated, the detent pin 66 moves over and between the gears or teeth in the track 64 to provide tactile feedback for the thumbwheel knob.

Figure 6:
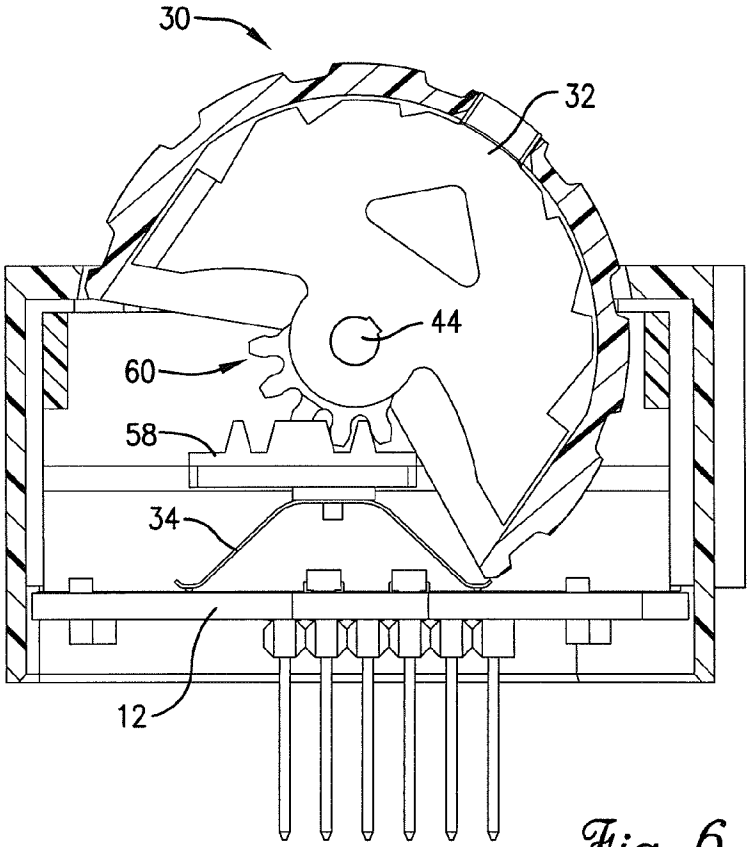
FIG. 6 is a side view in partial section of the thumbwheel switch assembly and circuit board with the thumbwheel knob shown fully rotated in an opposite direction.
Figure 5:
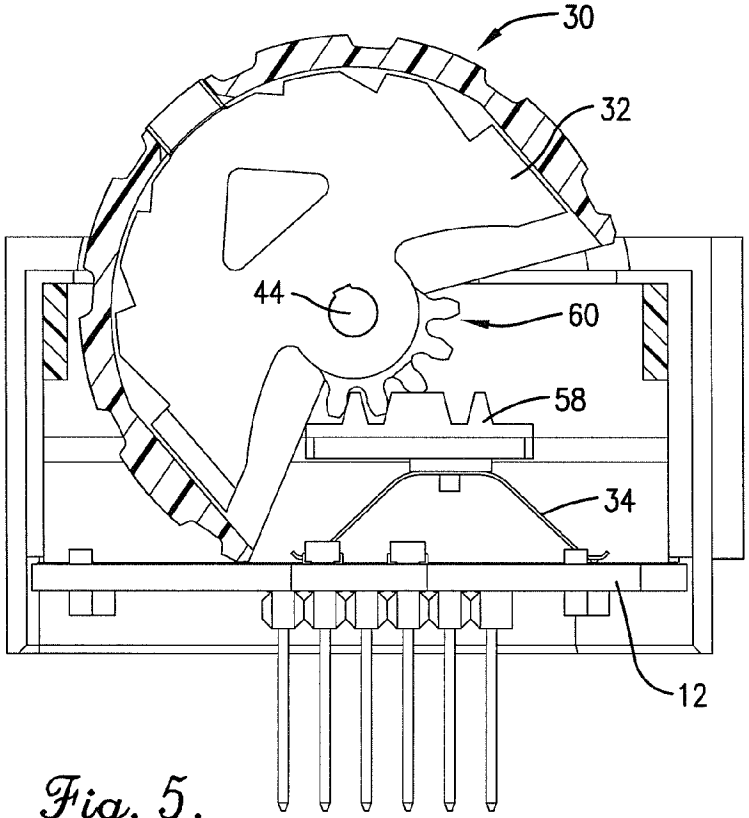
FIG. 5 is a side view in partial section of the thumbwheel switch assembly and circuit board with the thumbwheel knob shown fully rotated in one direction.

In operation, the thumbwheel switch assembly 16 described above and other embodiments of the switch assembly may be used to dim a light or provide a variable signal to any electrical device. As the thumbwheel knob 30 is rotated, it moves the conductor 34 along the contact pads 20, 22 and adjusts a signal that passes through the conductor 34, contact pads 20, 22, and a set of resistors. For example, when the thumbwheel knob 30 is positioned at a first limit of its travel as shown in FIG. 5, it positions the conductor 34 so as to provide a high signal that may correspond to full power for the controlled light or other electrical device. Conversely, when the thumbwheel knob 30 is positioned at a second, opposite limit of its travel as shown in FIG. 6, it positions the conductor 34 so as to provide a low signal that may correspond to an off or fully dimmed power level for the light or other controlled device. Advantageously, the light guide 34 and rack and pinion assembly 36 provide for a constant and uniform illumination of the symbol 52 on the light guide throughout the entire range of motion of the thumbwheel knob.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

Although the invention has been described with reference to the preferred embodiment illustrated in the attached drawing figures, it is noted that equivalents may be employed and substitutions made herein without departing from the scope of the invention as recited in the claims. For example, many of the components shown on the circuit board 12 may be replaced and/or omitted entirely without affecting the scope of the invention.

Having thus described the preferred embodiment of the invention, what is claimed as new and desired to be protected by Letters Patent includes the following:

1. A switch assembly for controlling an electrical device, the switch assembly comprising:
- a circuit board;
- a light source mounted on the circuit board;
- a pair of electrical contacts on the circuit board;
- a thumbwheel knob rotatably mounted on the circuit board, the thumbwheel knob being configured to be rotated about an axis substantially parallel to the circuit board;
- a transparent window formed on the thumbwheel knob on which a symbol is applied or formed, the transparent window extending through an opening in the thumbwheel knob, the symbol being selected from the group consisting essentially of a word, letters, numbers, or a graphic;
- a light guide positioned within the thumbwheel knob for directing light from the light source to the transparent window to illuminate the symbol, the light guide comprising:
  - a plurality of angled surfaces; and
  - a central aperture, the plurality of angled surfaces being configured to reflect light from the light source to the central aperture and the central aperture being configured to reflect light from the angled surfaces to the transparent window;
- a detent mechanism for providing tactile feedback when the thumbwheel knob is rotated;
- an electrical conductor configured to contact and move relative to the contacts; and
- a rack and pinion assembly for moving the conductor relative to the contacts when the thumbwheel knob is rotated, the rack and pinion assembly comprising:
  - a rack coupled with the electrical conductor; and
  - a pinion coupled with the light guide and operable to move the rack and the electrical conductor when the thumbwheel knob is rotated.

2. A thumbwheel switch assembly comprising:
- a circuit board;
- a light source mounted on the circuit board;
- a rotatable thumbwheel knob mounted on the circuit board and configured to be rotated about an axis substantially parallel to the circuit board;
- a transparent window that moves with the knob and on which a symbol is applied or formed;
- a light guide for directing light from the light source to the transparent window to illuminate the symbol, the light guide comprising:
  - a plurality of angled surfaces; and
  - a central aperture, the plurality of angled surfaces being configured to reflect light from the light source to the central aperture and the central aperture being configured to reflect light from the angled surfaces to the transparent window;
- a conductor for making electrical contact with a circuit; and
- a rack and pinion assembly coupled between the thumbwheel knob and the conductor for converting rotational movement of the thumbwheel knob to linear movement of the conductor.

3. A thumbwheel switch assembly as set forth in claim 2, wherein the rack and pinion assembly comprises:
- a rack coupled with the electrical conductor; and
- a pinion coupled with the light guide and operable to move the rack and the electrical conductor when the thumbwheel knob is rotated.

4. A thumbwheel switch assembly as set forth in claim 2, wherein the transparent window is formed on the light guide and wherein the thumbwheel knob includes an opening through which the transparent window extends.

5. A thumbwheel switch assembly as set forth in claim 2, further comprising a detent mechanism for providing tactile feedback when the thumbwheel knob is rotated.

6. A thumbwheel switch assembly as set forth in claim 3, wherein the pinion is integrally formed with the light guide.

7. A thumbwheel switch assembly as set forth in claim 3, wherein the rack includes an opening for passing light from the light source to the light guide.

8. A thumbwheel switch assembly as set forth in claim 3, wherein the transparent window is formed on the light guide and wherein the knob includes an opening through which the transparent window extends.

9. A switch assembly as set forth in claim 2, wherein the symbol is a word, letters, numbers, or a graphic.

* * * * *